US005318459A

United States Patent [19]

Shields

[11] Patent Number: 5,318,459

[45] Date of Patent: Jun. 7, 1994

[54] RUGGEDIZED, SEALED QUICK DISCONNECT ELECTRICAL COUPLER

[76] Inventor: Winston E. Shields, 8612 W. 127th St., Palos Park, Ill. 60464

[21] Appl. No.: 853,282

[22] Filed: Mar. 18, 1992

[51] Int. Cl.[5] ..... H01R 13/52

[52] U.S. Cl. ..... 439/527; 439/559; 439/565

[58] Field of Search ..... 285/192, 199; 174/65 SS; 439/527, 592, 544, 550, 551, 556, 559, 564, 565

[56] References Cited

U.S. PATENT DOCUMENTS 4,588,247 5/1986 Grappe et al. ..... 439/556 X
5,051,541 9/1991 Bawa et al. ..... 174/65 SS

*Primary Examiner*—Eugene F. Desmond
*Attorney, Agent, or Firm*—Emrich & Dithmar

[57] ABSTRACT

A quick disconnect electrical coupler for connecting an electrical cable, or cord, to circuitry in a closed housing forms a sealed, high strength, impact resistant connection between the housing and a flexible conduit within which the electrical lead is disposed. The quick disconnect electrical coupler includes a conduit adapter in sealed engagement about an aperture in the housing which is coupled to the conduit by means of a threadable compression connection. Electrical leads coupled to circuitry in the housing terminate in a plurality of conductive pins disposed within an inner connector housing adapted for mating engagement with a conventional socket-type lead connector coupled to the electrical cable. A connector adapter is disposed about the inner connector housing and within the conduit adapter and is in sealed engagement with these two components. The connector adapter includes an outer threaded portion adapted for coupling to the socket-type lead connector within the liquid tight, sealed combination of the conduit adapter and the flexible conduit, which combination also maintains the electrical leads in fixed position within the conduit and conduit adapter and protects the electrical cable and connector from impact damage. Another embodiment replaces the connector adapter and inner connector housing with a ringed, tapered seal for securely coupling the conduit adapter and flexible conduit in a moisture-tight sealed manner while maintaining the electrical leads in fixed position within the electrical coupler.

19 Claims, 3 Drawing Sheets

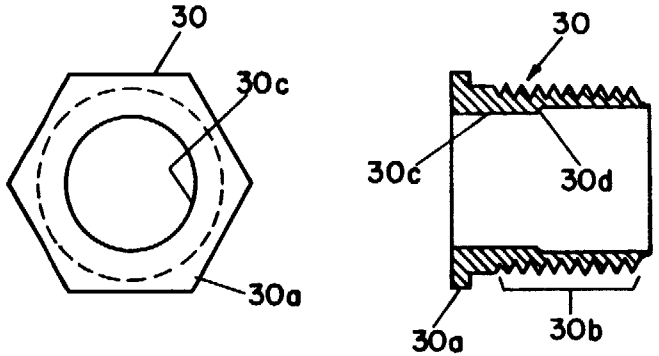
Fig. 4a
Fig. 4b
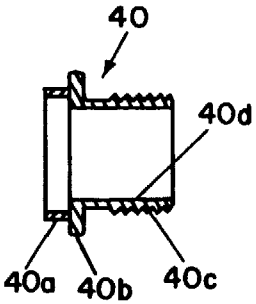
Fig 5a
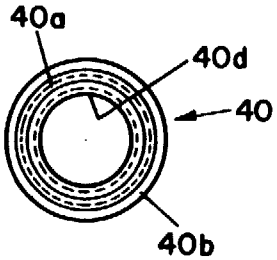
Fig 5b
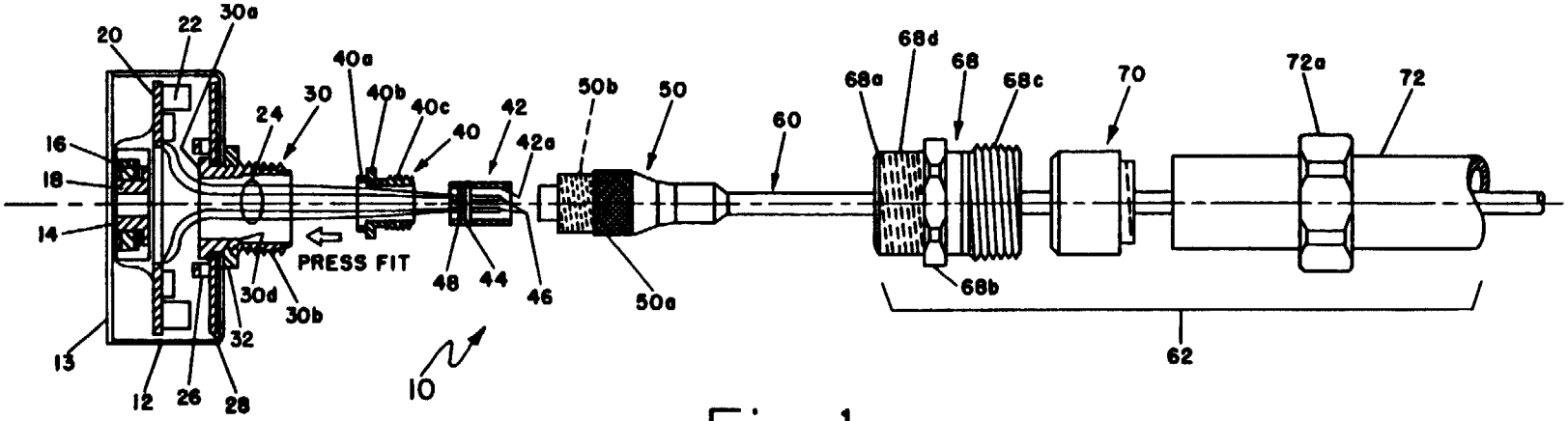
Fig. 1

RUGGEDIZED, SEALED QUICK DISCONNECT ELECTRICAL COUPLER

FIELD OF THE INVENTION

This invention relates generally to liquid tight electrical connectors and is particularly directed to a ruggedized, sealed quick disconnect coupling arrangement for connecting an electrical lead to circuitry within a housing.

BACKGROUND OF THE INVENTION

An electrical circuit disposed within a closed housing is typically connected through the housing to appropriate external circuitry such as a power supply or a data/-control signal source or processing circuit. The electrical circuit is generally enclosed in a housing to isolate it from the environment, insulate it from other circuits and conductors, and mechanically protect it from impact damage. An electrical lead typically extends through an aperture in the housing and is connected to circuitry within the housing. The lead may also be coupled to an external cable by a suitable connector. Frequently several leads extend through the housing's aperture and are coupled to a multi-lead cable via a multi-pin connector. An O-ring may be inserted in the aperture of the housing and disposed about the leads or cable to provide a limited seal for the leads and circuitry within the housing and to protect the leads from damage by contacting that portion of the housing defining the aperture through which the leads extend. This arrangement affords only limited cable protection and isolation of the internal circuitry from the environment external to the housing. For example, this arrangement is subject to leakage of moisture and other contaminants into the housing as well as impact damage to the cable and connector extending from the housing. Where a conduit connector extends from the housing, a potting compound is frequently incorporated in the connector to fill voids therein. This increases the cost of the installation and still does not ensure a leak-free connection.

The present invention addresses the aforementioned problems of the prior art and by providing a ruggedized, sealed quick disconnect electrical coupler for a cable extending through an aperture in a housing containing electrical circuitry.

OBJECTS AND SUMMARY OF THE INVENTION

Accordingly, it is an object of the present invention to provide a ruggedized, liquid-tight sealed detachable coupling arrangement for an electrical cable.

It is another object of the present invention to provide a sealed coupler for connecting an electrical cable to circuitry within a generally closed housing which protects the cable from mechanical damage while allowing the cable to be easily and quickly disconnected from the housing.

Yet another object of the present invention is to provide a quick disconnect coupling arrangement for a multilead electrical cable, or cord, which is comprised of a minimum number of components, protects the cable from mechanical damage, and insulates the cable and electrical connection from moisture and foreign material.

This invention contemplates a quick disconnect sealed electrical coupler for connecting an electrical cable to leads from a sensor circuit within a housing, the electrical coupler comprising: a conduit adapter coupled to the housing and disposed about an aperture therein for forming a seal with the housing, wherein the sensor leads pass through the aperture in the housing and are disposed within the conduit adapter; a conduit disposed about the electrical cable and coupled to the conduit adapter for isolating the electrical cable from its surroundings a quick disconnect coupler for connecting the electrical cable to the sensor leads; and a connector adapter for coupling the sensor leads to the quick disconnect coupler, wherein the connector adapter is in sealed engagement with the conduit adapter and the quick disconnect coupler engages and maintains the sensor leads in fixed position within the electrical coupler.

BRIEF DESCRIPTION OF THE DRAWING

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is an exploded lateral view, shown partially in phantom, of a ruggedized, sealed quick disconnect coupler in accordance with the principles of the present invention;

FIGS. 4*a* and 4*b* are respectively end-on and lateral sectional views of a conduit adapter used in one embodiment of the quick disconnect electrical coupler of the present invention;

FIGS. 5*a* and 5*b* are respectively lateral sectional and end-on views of a connector adapter used in one embodiment of the quick disconnect electrical coupler of the present invention;

DETAILED DESCRIPTION OF THE PREFERRED EMBODIMENTS

Figure 3:
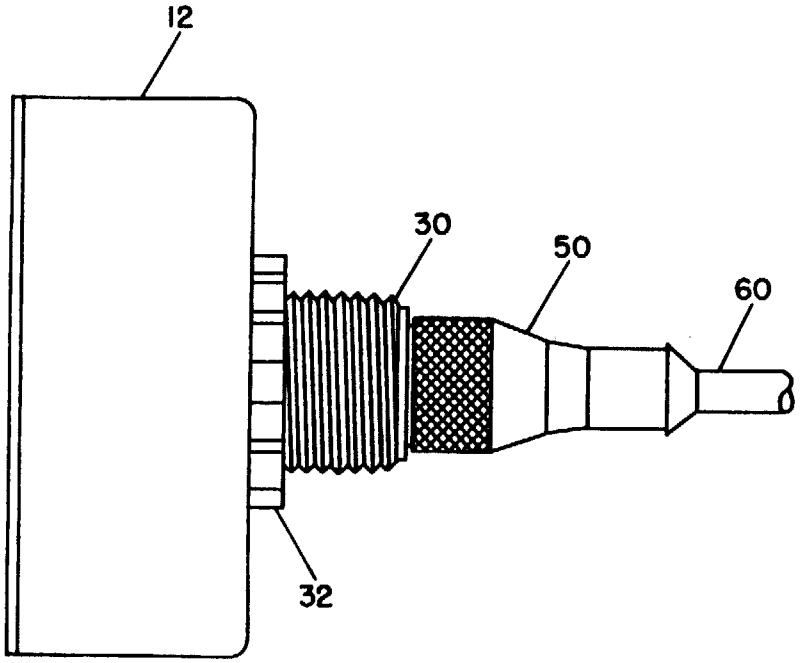
FIG. 3 is a side plan view of the assembled quick disconnect electrical coupler of FIG. 2.
Figure 2:
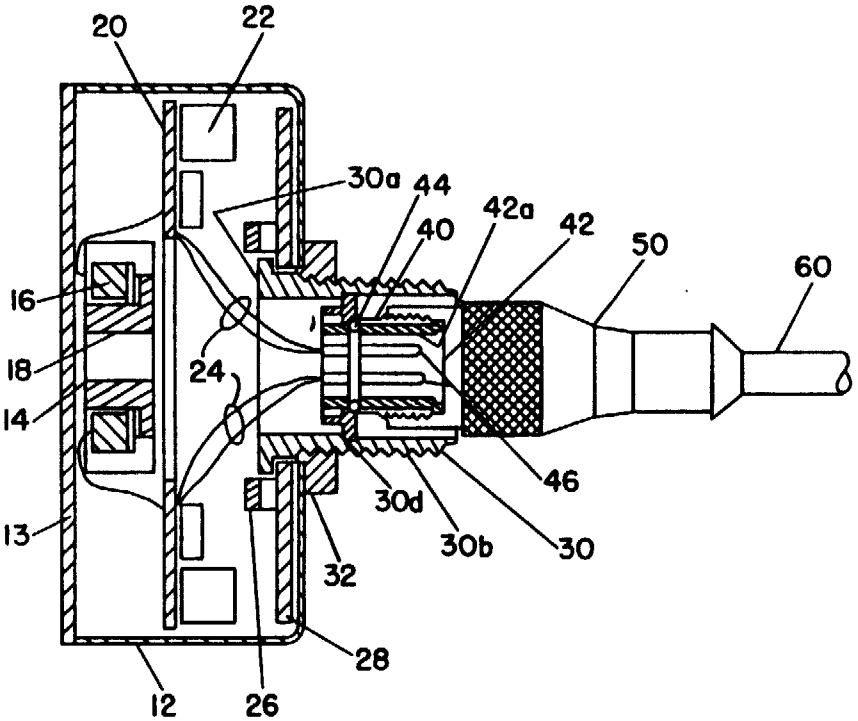
FIG. 2 is a lateral view, also shown partially in phantom, of a portion of an assembled ruggedized, sealed quick disconnect electrical coupler in accordance with the present invention.

Referring to FIG. 1, there is shown an exploded side view of a ruggedized, sealed quick disconnect electrical coupler 10 in accordance with the present invention. The left-hand portion of the electrical coupler 10 is shown in phantom in order to illustrate additional details of the invention. A portion of the assembled quick disconnect electrical coupler is shown partially cutaway in FIG. 2 and in a lateral plan view in FIG. 3.

The quick disconnect electrical coupler 10 connects an electrical cable, or cord, 60 to a sensor 12. The sensor 12 includes a housing 13 typically comprised of metal or plastic. The housing 13 is generally closed, having an aperture therein within which is positioned a conduit adapter 30. Disposed within housing 13 is a sensor 14 such as of the electromagnetic type including a coil, or windings, 16 and a ferrite core 18. Coil 16 is electrically coupled to various electronic components, or circuitry, 22 disposed on a printed circuit (PC) board 20 within sensor housing 13. A plurality of conductors 24 are electrically coupled to the electronic components 22 and terminate in a plurality of conductive pins 46 disposed within a connector housing 42.

The electrical leads 24 extend out of the aperture of the sensor housing 13 and are disposed within the conduit adapter 30. Details of the conduit adapter 30 are shown in the end-on and lateral sectional views of FIGS. 4*a* and 4*b*. The conduit adapter 30 includes an aperture, or slot, 30*c* extending the length thereof through which the electrical leads 24 extend. Conduit adapter 30 further includes a hex nut, or flange, 30*a* on a first end thereof and a threaded portion 30*b* on a second, opposed end portion thereof. The threaded portion 30*b* is disposed on an outer surface of the conduit adapter 30, while an inner shoulder 30*d* is disposed within the conduit adapter's aperture 30*c*. Threads 30*b* are a standard tapered pipe thread which form a liquid-tight seal when connected to a mating female thread in a preferred embodiment.

Also disposed within sensor housing 13 is a reinforcing, or stiffener, plate 28. Reinforcing plate 28 also includes an aperture therein which is aligned with the aperture in sensor housing 13. Reinforcing plate 28 is preferably comprised of metal or a high strength plastic for increasing the strength and ruggedness of the coupler installation. Disposed on an inner surface of reinforcing plate 28 about the aperture therein are a plurality of ears 26. Ears 26 are disposed in closely spaced relation about the hex nut end 30*a* of the conduit adapter 30 to prevent rotation of the conduit adapter when threadably engaged by means of a lock nut 32. Tightening of lock nut 32 on the threaded portion 30*b* of conduit adapter 30 outside of sensor housing 13 allows for secure attachment of the conduit adapter to the sensor housing 13 in a liquid-tight seal. The secure attachment of the conduit adapter 30 to sensor housing 13 also protects the electrical leads 24 and various components of the electrical coupler disposed within the conduit adapter from damage by impact forces.

Disposed within the aperture 30*c* of the conduit adapter 30 is a connector adapter 40. Connector adapter 40 is also generally cylindrical in shape and includes an aperture 40*d* extending the length thereof as shown in the lateral sectional and end-on views of the connector adapter of FIGS. 5*a* and 5*b*. Connector adapter 40 further includes a first end 40*a*, a second threaded end portion 40*c*, and an outer flange 40*b* disposed therebetween. With connector adapter 40 inserted in the aperture 30*c* of conduit adapter 30, the connector adapter's flange 40*b* engages the inner shoulder 30*d* of the conduit adapter in a sealed manner. Connector adapter 40 is preferably press fit into secure engagement with conduit adapter 30 to ensure secure coupling between these two components.

Inserted within the aperture 40*d* of the connector adapter 40 is a connector housing 42. Connector housing 42 is also generally cylindrical in shape and includes an aperture 42*a* extending the length thereof. Disposed within connector housing 42 is a spacer, or partition, 48 having a plurality of apertures therein. Each of the apertures within spacer 48 is adapted to receive and engage a conductive pin 46. Each of the pins 46 is coupled at one end thereof to a respective one of the electrical leads 24 extending from the electronic components 22 on the PC board 20. Spacer 48 maintains the conductive pins 46 in fixed position within the connector housing 42 and ensures proper spacing between these pins. Spacer 48 also supports and maintains fixed positioning of the electrical leads 24 within the electrical coupler 10. An O-ring seal 44 is disposed on an outer portion of connector housing 42 and is adapted for secure engagement with an inner portion of connector adapter 40 when the connector housing is inserted into the connector adapter. The inner wall of the connector adapter 40 as well as the outer wall of the connector housing 42 may be tapered to ensure tight-fitting engagement of O-ring seal 44 with these two members. O-ring seal 44 is preferably comprised of a high strength, compressible material such as neoprene, while connector adapter 40 and connector housing 42 are preferably comprised of metal or a high strength plastic material. As in the case of attachment of connector adapter 40 to conduit adapter 30, connector housing 42 is preferably press fit into the connector adapter.

Coupled to the connector adapter 40 is a plug-type lead connector 50. Lead connector 50 has at a first end a plurality of socket-like receptacles (not shown) each adapted for receiving and engaging a respective contact pin 46 in the connector housing 42. Lead connector 50 also includes at one end thereof an internal threaded portion shown in FIG. 1 in dotted line form for engaging and coupling to the threaded end portion 40*c* of the connector adapter 40. Lead connector 50 further includes an outer gripping portion 50*a* to facilitate rotational displacement of the lead connector in connecting and disconnecting it from connector adapter 40 and the contact pins 46 within the connector housing 42. Coupled in a conventional manner to the plug-like terminals of the lead connector 50 and extending from a second end thereof is the multi-conductor cable 60. Lead connector 50 allows for the quick coupling and decoupling of electrical cable 60 from the sensor assembly 12.

Disposed about electrical cable 60 is a sealed connector 62 of conventional design. Sealed connector 62 includes a connector body 68, a compressible ferrule 70, and a conduit 72. Connector body 68 includes a first end 68*a* having an internal threaded portion 68*d* adapted for engaging the threaded portion 30*b* of the conduit adapter 30. A hex nut flange 68*b* is disposed about the connector body 68 to facilitate rotational displacement of the connector body in connecting and disconnecting it from the conduit adapter 30. Disposed on a second, opposed end of the connector body 68 is an external threaded portion 68*c*. Connector body 68 further includes an elongated aperture extending the length thereof within which is positioned the electrical cable 60.

The second threaded end portion 68*c* of the connector body 68 is adapted to receive the compressible ferrule 70 as well as an end of conduit 72. A compression nut 72*a* disposed about conduit 72 is adapted for engaging the threaded portion 68*c* of the connector body 68. Tightening of compression nut 72*a* on the threaded end portion 68*c* of the connector body 68 provides a compression fit between connector body 68 and conduit 72. Compressible ferrule 70 is preferably comprised of brass or a plastic material. Ferrule 70 forms a seal between the connector body 68 and conduit 72, which also preferably is comprised of a metal or a high strength plastic material. The combination of conduit adapter 30 and the sealed connector 62 isolates electrical leads 24 and cable 60 as well as the connection therebetween from moisture and other external contaminants. It should be noted that the side views of the electrical coupler shown in FIGS. 2 and 3 do not include elements of the sealed connector 62 shown in FIG. 1 for simplicity.

Figure 6:
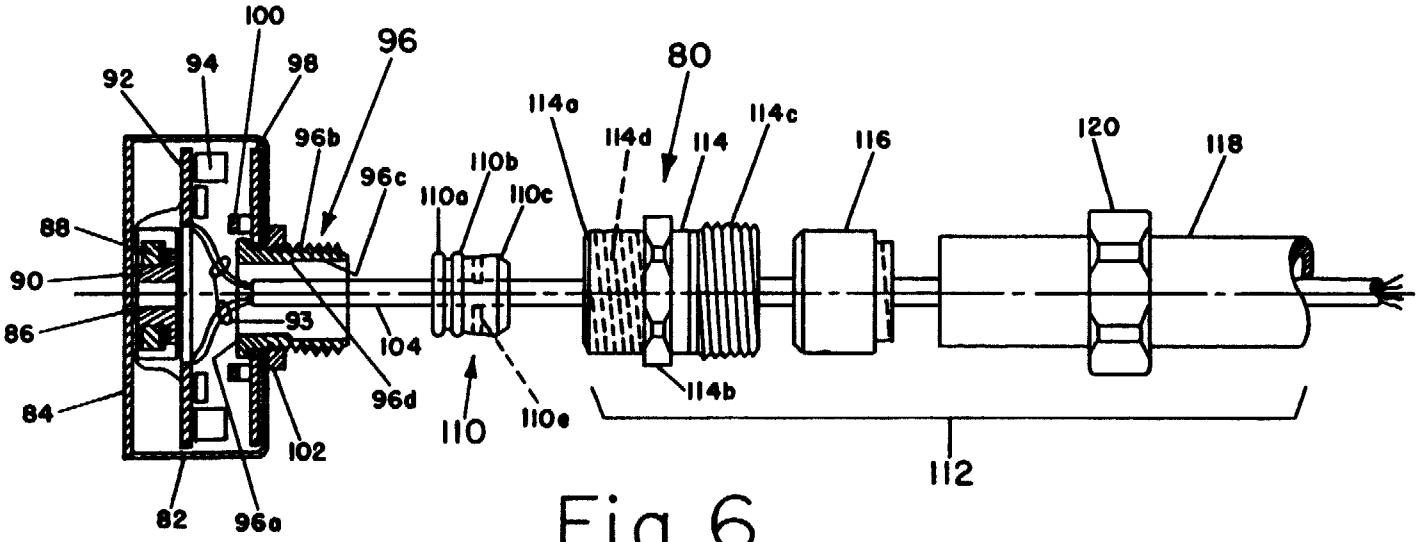
FIG. 6 is an exploded side view, shown partially in phantom, of another embodiment of a ruggedized, sealed electrical coupler in accordance with the present invention.
Figure 7B:
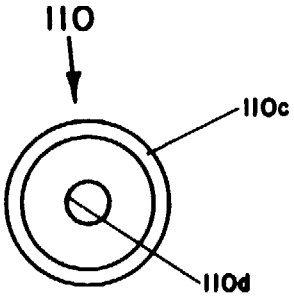
FIGS. 7*a* and 7*b* are respectively lateral and end-on views of a seal used in the embodiment of the invention shown in FIG. 6, where the lateral view is shown partially in phantom.
Figure 7A:
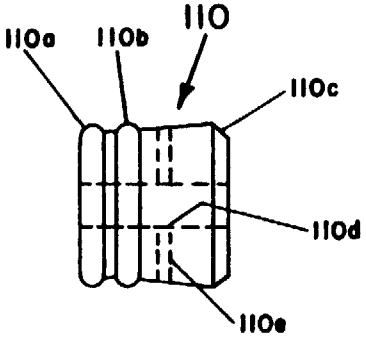

Referring to FIG. 6, there is shown a ruggedized, sealed electrical coupler 80 in accordance with another embodiment of the present invention. As in the previously described embodiment, the electrical coupler 80 shown in FIG. 6 is adapted for coupling an electrical cable 104 to circuitry 94 within a sealed sensor housing 82 in a moisture proof, ruggedized installation which protects the electrical components and conductors from mechanical damage as well as from exposure to external contaminants.

Sensor 82 includes a housing 84 within which are disposed an electromagnetic sensor 86 comprised of a coil 88 and a ferrite core 90. The coil 88 is electrically coupled to various electronic components, or circuitry, 94 on a PC board 92 within the sensor housing 84. Circuitry 94 is, in turn, coupled to a plurality of conductors 93 which extend through an aperture in sensor housing 84 and are disposed within cable 104.

As in the previous embodiment, a reinforcing plate 98 is disposed in contact with an interior wall of the sensor housing 84 and about an aperture therein. Attached to and extending from the reinforcing plate 98 are a plurality of spaced ears 100. Reinforcing plate ears 100 are positioned in closely spaced relation to a hex nut flange end portion 96*a* of a conduit adapter 96 positioned within the aperture of the sensor housing 84. The reinforcing plate ears 100 prevent rotation of the conduit adapter 96 when a threaded end portion 96*b* of the conduit adapter 96 is engaged by a lock nut 102. Tightening of lock nut 102 forms a moisture proof seal between sensor housing 84 and the conduit adapter 96.

Inner threads 114*d* on a first end portion 114*a* of a connector body 114 are adapted to engage the threaded portion 96*b* of the conduit adapter 96. A hex nut flange 114*b* disposed about the connector body 114 facilitates coupling the connector body to the conduit adapter 96 as well as its removal therefrom. A second, opposed end of the connector body 114 is provided with an external threaded portion 114*c* which is adapted for receiving a compression nut 120 disposed about a conduit 118. A compressible ferrule 116 inserted within connector body 114 and engaged by one end of conduit 118 forms a seal between the connector body and the conduit. The combination of connector body 114, compressible ferrule 116 and conduit 118 forms a sealed connector 112 with the conduit adapter 96 extending from sensor housing 84. As shown in FIG. 6, cable 104 is inserted through connector body 114, compressible ferrule 116 and conduit 118.

The ruggedized, sealed electrical coupler 80 further includes a seal 110 positioned within adjacent ends of the conduit adapter 96 and connector body 114. Seal 110 is generally cylindrical and includes an aperture extending the length thereof within which is positioned cable 104. Seal 110, which preferably is comprised of a high strength, compressible material such as neoprene, includes an internal spacer, or partition, shown in FIG. 6 in dotted-line form as element 110*e*, for engaging and maintaining proper spacing of cable 114 within conduit adapter 96 and sealed connector I12. Disposed on a first end of seal 110 is a first end O-ring 110*a* which is adapted for tight-fitting engagement with an inner shoulder 96*d* disposed within the aperture 96*c* of the conduit adapter 96. Seal 110 further includes a second intermediate O-ring 110*b* disposed along the length of the seal for similarly engaging the conduit adapter 96 about the aperture 96*c* therein. A second, opposed end 110*c* of seal 110 is provided with a bevelled edge to ensure tight-fitting engagement with an inner portion of connector body 114. In proceeding from the first O-ring 110*a* to the second end 110*c* of seal 110, the seal is tapered outward to further ensure tight sealing engagement between the seal and connector body 114. The combination of conduit adapter 96, seal 110 and sealed connector 112 provides a water tight and mechanically rugged connection for cable 114 to sensor circuitry 94.

There has thus been shown a ruggedized, sealed quick disconnect coupler for connecting an electrical cable to leads from circuitry within a closed housing which affords a sealed, high strength, impact resistant connection between the housing and a flexible conduit containing the cable. Sealed coupler components engage the electrical leads from the housing and maintain the leads in fixed position within the coupler as they exit the housing. Quick disconnect threaded couplers facilitate coupling and decoupling the liquid tight seal as well as the electrical connection between the sensor leads and the cable.

While particular embodiments of the present invention have been shown and described, it will be obvious to those skilled in the art that changes and modifications may be made without departing from the invention in its broader aspects. For example, while the conduit adapter is shown coupled to the conduit via a quick disconnect threaded coupling arrangement, the present invention may also be used where the conduit is connected to the conduit adapter in a more permanent installation such as via a clamp or other attachment means. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A quick disconnect sealed electrical coupler for connecting an electrical cable to leads from a sensor circuit within a housing, said electrical coupler comprising:

conduit adapter means coupled to the housing and disposed about an aperture therein for forming a seal with the housing, wherein the sensor leads pass through the aperture in the housing and are disposed within said conduit adapter means;

conduit means disposed about the electrical cable and coupled to the conduit adapter means for isolating the electrical cable from its surroundings;

first quick disconnect coupling means having a first threaded portion for connecting the electrical cable to the sensor leads; and connector adapter means for coupling the sensor leads to said first quick disconnect coupling means, wherein said connector adapter means is in sealed engagement with said conduit adapter means and wherein said connector adapter means includes a second threaded portion adapted for threaded coupling to said first threaded portion of said first quick disconnect coupling means and wherein said connector adapter means engages and maintains the sensor leads in fixed position within the electrical coupler.

2. The electrical coupler of claim 1, wherein said conduit adapter means includes an inner flanged end disposed within the sensor housing and an outer threaded end.

3. The electrical coupler of claim 2 further comprising reinforcing means disposed within the sensor housing and about the aperture therein for strengthening a wall of the sensor housing adjacent to said conduit adapter means.

4. The electrical coupler of claim 3, wherein said reinforcing means includes a generally flat plate having an aperture therein through which said conduit adapter means extends.

5. The electrical coupler of claim 4, wherein said plate includes ear means engaging said conduit adapter means for preventing rotation of said conduit adapter means within the housing.

6. The electrical coupler of claim 2 further comprising second quick disconnect coupling means for securely coupling said conduit adapter means and said conduit means in a sealed manner.

7. The electrical coupler of claim 6, wherein said second quick disconnect coupling means includes a threaded connector body for coupling to the outer threaded end of said conduit adapter means.

8. The electrical coupler of claim 7, wherein said second quick disconnect coupling means further includes a compression fitting.

9. The electrical coupler of claim 1, wherein said connector adapter means includes, in combination, a connector adapter and a connector housing disposed about the sensor leads and respectively engaging said conduit adapter means and said first quick disconnect coupling means.

10. The electrical coupler of claim 9, wherein said first quick disconnect coupling means includes a female lead connector coupled to the electrical cable.

11. The electrical coupler of claim 9, wherein said connector adapter is disposed within said conduit adapter means and includes outer flange means for engaging an inner portion of said conduit adapter means in a sealed manner.

12. The electrical coupler of claim 11, wherein said connector housing is disposed within and engages said connector adapter.

13. The electrical coupler of claim 12 further comprising seal means disposed intermediate and in sealed contact with said connector adapter and said connector housing.

14. The electrical coupler of claim 13 wherein said connector housing includes spacer means for engaging the sensor leads and maintaining the leads in fixed position within the electrical coupler.

15. The electrical coupler of claim 14, wherein said connector housing further includes a plurality of pins each coupled to a respective sensor lead and adapted for coupling to said female lead connector.

16. A sealed electrical coupler for connecting an electrical cable to a sensor circuit within a housing, said electrical coupler comprising:

conduit adapter means coupled to the housing and disposed about an aperture therein for forming a seal with the housing, wherein the cable passes through the aperture in the housing and is disposed within said conduit adapter means;

conduit means disposed about the electrical cable for isolating the electrical cable from its surroundings;

coupling means for securely coupling said conduit adapter means and said conduit means in a sealed manner; and seal means disposed within and in abutting contact with said conduit adapter means and said coupling means for forming a tight seal between said conduit adapter means and said coupling means, wherein said seal means engages and maintains the cable in fixed position within the electrical coupler and wherein said seal means is generally cylindrical and includes an aperture within which the electrical cable is disposed, said seal means further including at least one outer O-ring for engaging an inner portion of the electrical coupler in a sealed manner.

17. The electrical coupler of claim 16, wherein said seal means is comprised of neoprene.

18. The electrical coupler of claim 16, wherein said conduit adapter means includes an inner flanged end disposed within the sensor housing and an outer threaded end coupled to said coupling means.

19. The electrical coupler of claim 18 further comprising reinforcing means disposed within the sensor housing and about the aperture therein for strengthening a wall of the sensor housing adjacent to said conduit adapter means.

* * * * *